United States Patent [19]

Pravda

[11] Patent Number: 4,640,344

[45] Date of Patent: Feb. 3, 1987

[54] SELF-CLEANING, ROTARY HEAT EXCHANGER

[75] Inventor: Milton F. Pravda, Towson, Md.

[73] Assignee: Manco Corporation, Walla Walla, Wash.

[21] Appl. No.: 836,064

[22] Filed: Mar. 4, 1986

[51] Int. Cl.[4] ..... F28D 5/00

[52] U.S. Cl. ..... 165/86; 165/119; 165/133; 165/111; 165/921; 165/95; 34/86

[58] Field of Search ..... 165/86, 119, 47, 54, 165/133, 111, 921; 34/86

[56] References Cited

U.S. PATENT DOCUMENTS

| | | | |
|---|---|---|---|
| 1,901,370 | 3/1933 | Kuhner | 165/119 |
| 2,037,490 | 4/1936 | Vorkauf | 165/119 |
| 3,621,908 | 11/1971 | Pravda . | |
| 3,740,966 | 6/1973 | Pravda . | |
| 4,000,778 | 1/1977 | Laing | 165/86 |
| 4,405,013 | 9/1983 | Okamoto | 165/86 |

FOREIGN PATENT DOCUMENTS

| | | | |
|---|---|---|---|
| 19691 | 2/1983 | Japan . | |
| 1600404 | 10/1981 | United Kingdom | 165/86 |

*Primary Examiner*—Albert W. Davis, Jr.
*Attorney, Agent, or Firm*—Eugene D. Farley

[57] ABSTRACT

A rotary, Perkins tube heat exchanger for processing hot contaminated gas flows emanating from appliances such as laundry driers, grain driers and the like. The case of the heat exchanger is located relative to the rotor so as to lie in the gas flow boundary layer established by the latter. The case is provided with a boundary layer purge port in the hot gas chamber. An airfoil extends inwardly from the case into the gas flow boundary layer. It causes increased local turbulance in the boundary layer gas. It also diverts a predetermined proportion of the boundary layer gas and its burden of contamination products out through the purge port. The boundary layer airflow cleans both the interior of the case and the rotor, even through the rotor is characterized by the presence of a multiplicity of small openings. The device thus is rendered self-cleaning and may be operated for extended periods of time without buildup of contaminants within the heat exchanger case.

16 Claims, 3 Drawing Figures

SELF-CLEANING, ROTARY HEAT EXCHANGER

BACKGROUND OF THE INVENTION

This invention relates to self-cleaning, rotary heat exchangers. It pertains particularly to self-cleaning heat exchangers of the class relying for heat exchange function upon the inclusion of a plurality of Perkins tubes ("heat pipes"). It is described herein with particular reference to heat exchangers employed in conjunction with laundry dryers, although no limitation thereby is intended since it is applicable with equal facility to such appliances as grain dryers, and the various processing units to be found in the textile, food, and fiberboard manufacturing industries.

In the foregoing and other industrial and chemical processes, large quantities of thermal energy in the form of heated gas (usually air) are required to drive off moisture and/or chemical solvents from the materials processed. As a result, the air becomes contaminated not only with moisture or solvents, but also with abrasive particulates emanating from the processed materials and products.

The contaminated air must be discharged from the processing apparatus. It contains valuable residual thermal energy and possibly valuable solvents. It also frequently contains lint, dust, fibers, or other environmentally objectionable materials. In order to recover either the residual thermal energy or the vaporized solvents, the discharged contaminated air must be cooled. Usually, it also must be processed to remove the environmentally objectionable materials.

The application of conventional heat exchangers to the solution of this problem is attended by the difficulty that in the conventional heat exchanger, in order to improve heat transfer and to achieve compactness, metal heat exchanger components are employed in which the metal surfaces are closely spaced, thereby forming small airflow channels. As a result, particulates which are larger than the channel spacings are trapped at the entrances to the heat exchange surfaces and held there by the pressure developed by the flowing airstream. Gradually, these particulates accumulate to form a mat which impedes airflow and, if allowed to accumulate, eventually force the systems to be shut down for cleaning.

Contaminated exhaust air containing solvents also causes problems in small airflow channels. As the airstream is cooled, the solvents condense to form a solvent mist. The mist particles coalesce and adhere to the metal surface by virtue of surface tension. If the solvent is a plasticizer, as is commonly the case in the manufacture of plastic products, the condensed plasticizer gradually polymerizes and forms a solid within the small airflow channels. When this occurs, it is virtually impossible to remove the plasticizer without destroying the metal surfaces.

Contaminated air containing both particulates and solvents is an especially severe environment for heat exchangers. In this case, solid particles which enter the small airflow channels are trapped by the condensed solvent. The particles gradually form a cake which blocks the channels and renders the heat exchanger ineffective.

Particular problems are presented by the operation of the widely used commercial tumble-type laundry dryers through which high velocity heated air is passed. The high velocity hot air detaches lint from the fabrics and carries it out the exhaust of the dryer. The lint consists of fibers and fiber dust. Conventional heat exchange equipment employed to recover the thermal energy exhausted out of such a dryer has proved unsuccessful for two principal reasons:

First, the lint fibers quickly block the small passages. Cyclone separators have been applied to the solution of this problem; however, they are not efficient in removing the lint. Lint filters also have been employed; however, they too are inefficient and require periodic maintenance.

Second, the cyclone separators and lint filters do not remove the fiber dust.

When this dust reaches the heat exchanger, it settles on the heat exchange surfaces where it is trapped by the laminar boundary layer of the gas flow present in the exchanger. The dust is further held on the heat exchanger surfaces by moisture condensing thereon. Unless the dust is removed by periodic washing, the efficiency of the heat exchanger gradually is reduced. If the cleaning is delayed too long, the dust eventually will form a cake and cleaning by conventional means is very difficult.

Other methods have been proposed to maintain air-to-air heat exchangers operable in contaminated environments.

U.S. Pat. No. 4,025,362 discloses the use of high pressure jets employed periodically to clean the small airflow channels without removing the heat exchanger from operation.

U.S. Pat. No. 4,125,147 discloses the use of perforated endless belts to trap particulates before they enter the heat exchanger.

U.S. Pat. No. 4,068,709 and 4,095,349 disclose easily disassemblable heat exchangers which can be cleaned more easily in the disassembled configuration.

U.S. Pat. No. 4,326,344 discloses a heat exchange system in which lint is removed from contaminated air by means of a cyclone separator. Even with the cyclone the heat exchanger must be vacuum cleaned daily and washed with detergent every two weeks.

It is the general purpose of the present invention to provide a useful rotary heat exchanger which is self-cleaning during operation in many applications.

It is another object to provide a rotary heat exchanger which is adaptable for efficient use in applications involving the processing of hot exhaust gases containing not only particulate contaminants, but also condensible contaminants such as solvents and plasticizers.

It is a further object of the present invention to provide a heat exchanger which recovers efficiently for further use the heat energy content of contaminated hot gases as well as the solvent content thereof.

A further object of the present invention is the provision of a heat exchanger which embodies within a single piece of equipment of simple construction provision for self cleaning and heat transfer, thereby avoiding the necessity for removing equipment from service for periodic cleaning.

Still a further object of the present invention is the provision of equipment which recovers efficiently thermal energy from hot airstreams containing, singly or in combination, dust, lint, fibers, oils, moisture, resins, plasticizers, fats, and other particulates and solvents commonly found in industrial and commercial processes.

The presently described self-cleaning, rotary heat exchanger relies for its heat exchange function upon the presence of an annular array of Perkins tubes.

U.S. Pat. No. 76, 463 describes the construction and mode of operation of the Perkins tube the original purpose of which was to heat a bakery oven without contaminating the baked goods with the combustion gases present in the firebox of the oven.

This was accomplished by partly filling an iron tube with water. Air was removed by boiling the water and letting steam displace the air. After removal of the air, the tubes were hermetically sealed by welding. The tubes then were placed in an inclined position with one end (the evaporation end) in the firebox and the other end (the condensation end) in the breadbaking chamber. Steam generated in the hot evaporation end passed into the relatively cool condensation end where it condensed. The condensed steam (water) thereupon gravitated downwardly into the evaporation end of the tube for repetition of the cycle. Alternatives for gravitational return of the heat exchange liquid include use of an axial wick, (the use of which converts the Perkins tube to a heat pipe), vibration, or centrifugal force.

Rotary heat exchangers involving Perkins tubes as the heat exchange component are known to the art, for example in British Pat. No. 1,600,404, published Oct. 14, 1981; in Japanese Pat. No. 80/01510 (July 24, 1980); and in Japanese Pat. No. 0019691 (Feb. 4, 1983). However, the prior art does not disclose Perkins tube type rotary heat exchangers which are self-cleaning and applicable to the separation of various particulates from a processed gas.

SUMMARY OF THE INVENTION

The self-cleaning, rotary heat exchanger of my invention broadly comprises an outer case having a rotor mounted therein. The rotor is driven by a motor, turbine, or other suitable drive means.

A partition is mounted transversely on the rotor. It divides the case interior longitudinally into a hot exhaust gas chamber and a cool supply gas chamber.

An annular array of Perkins tubes is mounted longitudinally on the rotor with their evaporation ends extending into the exhaust gas chamber and their condensation ends extending into the supply gas chamber.

A first inlet port in the case is located for introducing into the exhaust gas chamber hot gas exhausted from an associated appliance and contaminated with entrained foreign materials. A first outlet port in the case is located for venting from the exhaust gas chamber a predetermined proportion of the exhaust gas in a cooled condition.

A second inlet port in the case is located for introducing cool supply gas into the supply gas chamber. A second outlet port in the case is located for venting heated supply gas from the supply gas chamber to an associated appliance.

A third outlet port in the case is located for continuously purging contaminated boundary layer exhaust gas out of the exhaust gas chamber.

The rotor is spaced from the case by a distance predetermined to locate the case within the gas flow boundary layer present between the rotor and the case. A longitudinally disposed airfoil extends inwardly from the case into the exhaust gas chamber boundary layer a distance predetermined to create or increase local turbulent gas flow therein and to divert a portion of the boundary layer gas and the contaminants contained therein out of the heat exchanger. By this method contaminant buildup, which could eventually cause the heat exchanger to become inoperative, is prevented.

In this assembly, the gas flow boundary layer scrubs clean the interior of the case. Because of its turbulent condition in the area of the airfoil, the gas flow also scrubs the rotor clean. The centrifugal force developed by the rotor supplements the cleaning action of the gas flow boundary layer by driving outwardly most particulates contained in the entering exhaust gas flow, and thus removing them from the rotor. In this manner, a self-cleaning function is imparted to the heat exchanger assembly.

The Drawings

DESCRIPTION OF A PREFERRED EMBODIMENT OF THE INVENTION

Figure 1:
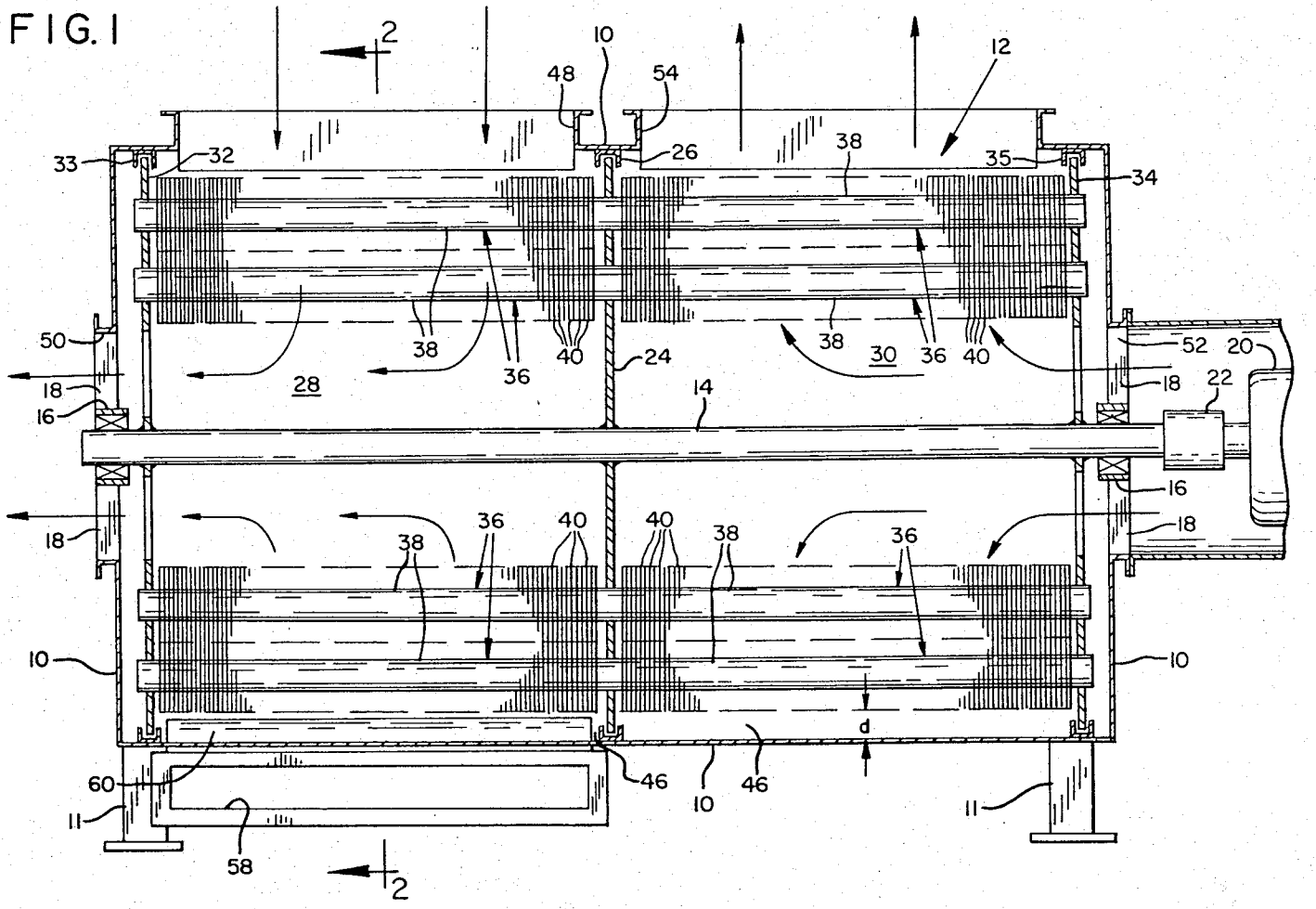
FIG. 1 is a longitudinal section of the self-cleaning rotary heat exchanger of my invention.
Figure 2:
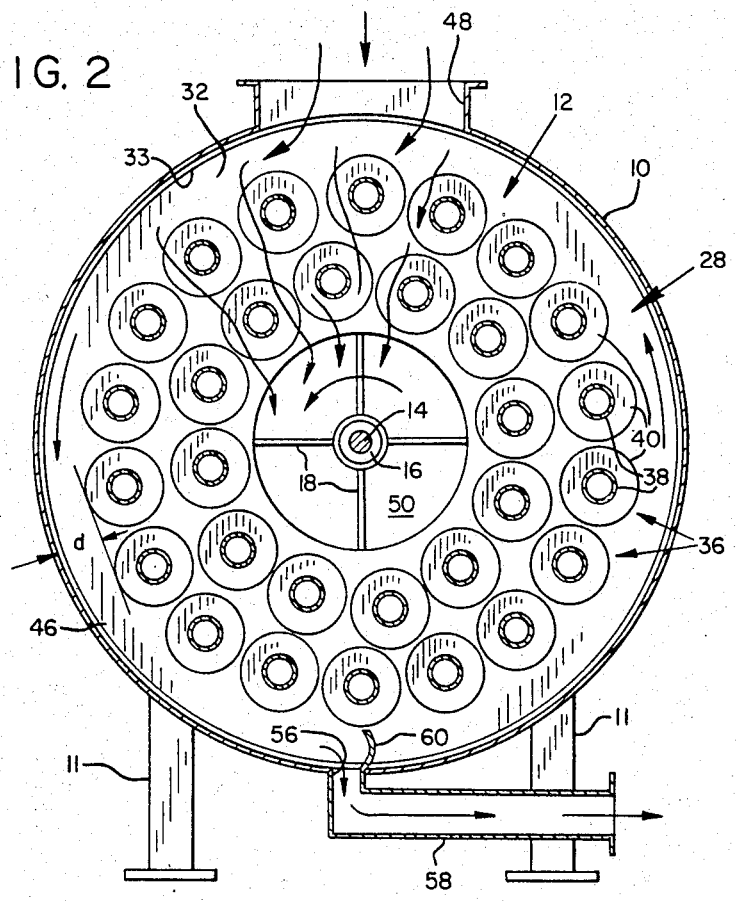
FIG. 2 is a transverse section taken along lines 2—2 of FIG. 1.

As shown in FIGS. 1 and 2, the self-cleaning, rotary heat exchanger of my invention includes an outer case 10 which is elongated and preferably substantially cylindrical in cross section. It is mounted on feet, or pedestals, 11.

The ends of the case are partly closed, with axially located openings. The interior of the case may be coated with a thin coating (not shown) of Teflon or other water-repellant coating material for a purpose which will appear hereinafter.

Case 10 houses a rotor indicated generally at 12.

The rotor is mounted on and attached to a central shaft 14 which extends longitudinally the entire length of the case, centrally thereof. It is mounted rotatably in bearings 16 which, in turn, are supported by struts 18 fixed to case 10.

The rotor is driven by a variable speed motor 20 to which it is coupled by means of a flexible coupling 22.

Shaft 14 mounts a centrally disposed, radially extending partition plate or barrier plate 24. The plate is rigidly mounted on the shaft, as by welding. Its diameter is but slightly less than the internal diameter of case 10. Its margin is received in a central seal 26.

Partition plate 24 accordingly divides the interior of case 10 into two chambers: A first chamber 28, termed herein an exhaust gas chamber since it receives hot, contaminated air or other gas vented from the dryer or other associated appliance; and a second chamber 30, termed herein a supply gas chamber, since it supplies fresh heated air or other gas to the appliance.

Rotor 12 also includes a pair of end plates having hollow centers interrupted only by spiders rigidly connected to central shaft 14. End plate 32 with associated seal 33, together with partition plate 24 and associated seal 26, defines exhaust gas chamber 28. End plate 34 with associated seal 35, together with partition plate 24 and associated seal 26, defines supply gas chamber 30.

Plates 24, 32 and 34 mount an array of Perkins tubes ("heat pipes") indicated generally at 36.

These elements of the assembly (FIG. 3) are substantially conventional in construction. They comprise a central, hollow tube or pipe 38 sealed at both ends and mounting a plurality of parallel, closely spaced, radially extending, heat dissipating fins or flanges 40. The fins are the elements of the assembly which are particularly susceptible to clogging by deposited particulate matter in rotary heat exchangers of this class.

Tube 38 is partly filled with a suitable heat exchange liquid, for example a fluorocarbon liquid such as difluorodichloromethane (Freon-12). Also, it may be internally grooved as disclosed in Pat. No. 4,326,344 in order to improve internal heat transfer.

As shown particularly in FIG. 2, the plurality of Perkins tubes are arranged in an annular array comprising two concentric rows, with the components of one row being in offset or staggered relation to the components of the other row. In large diameter heat exchangers, more than two annular rows may be used.

Figure 3:
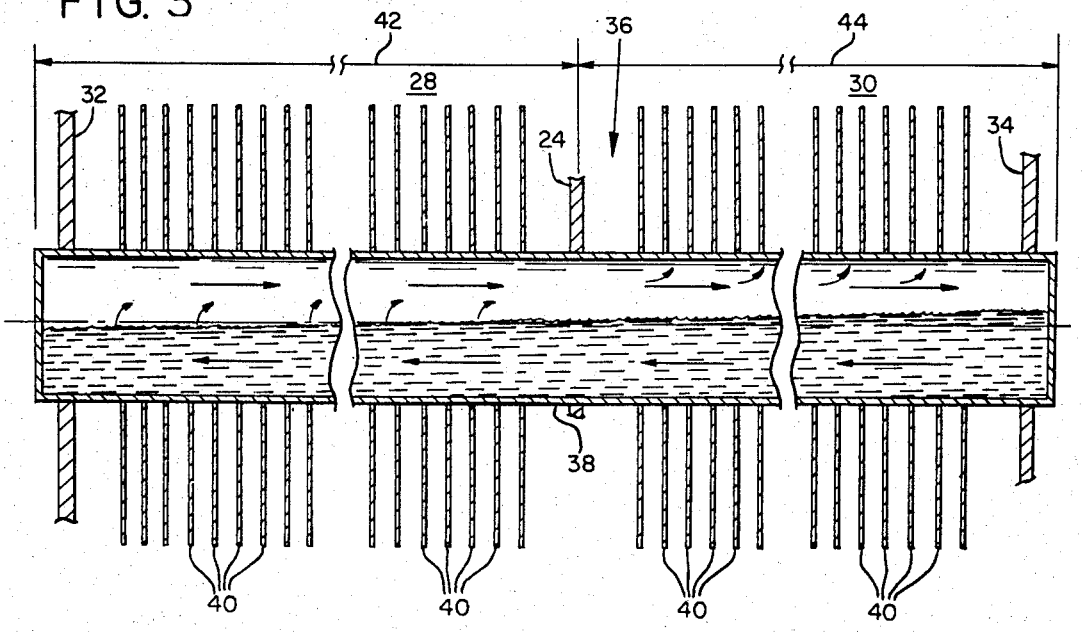
FIG. 3 is a foreshortened, longitudinal section of one of the finned Perkins tubes, an annular array of which is present in the heat exchanger.

The array is mounted on plates 24, 32 and 34 within case 10 with the evaporation ends of the tubes, indicated by dimension 42 of FIG. 3, extending into exhaust gas chamber 28 and the condensation ends of the tubes, indicated by dimension 44 of FIG. 3, extending into supply gas chamber 30. Dimension 42 may be equal to or different from dimension 44.

The circulation of fluid and fluid vapor within the tubes is as indicated by the arrows of FIG. 3. The heat exchange liquid is vaporized in hot exhaust gas chamber 28 (shown by arrows emanating from the liquid surface) and passes as a vapor into cool supply gas chamber 30 where it is condensed (shown by arrows pointing to the metal surface). The condensed gas (liquid) then is driven by the centrifugal force generated by the rotor back into the exhaust gas chamber, where the cycle again is initiated.

Rotor 12 is spaced axially from case 10 by a distance "d" (FIG. 2) predetermined to provide in the internal peripheral area of the case an annular space 46. This is the region of boundary layer airflow, which is important to the concept of the present invention.

It is well known that a surface traveling through air or other gas will drag or pump a portion of the air along its surface in the form of a traveling boundary layer. This boundary layer may be laminar, transitional, or turbulent. In the apparatus of the invention, case 10 is disposed relative to the rotor so that it lies within the traveling gaseous boundary layer developed by the latter.

Stationary cylindrical case 10 is provided with five openings or ports with associated ductwork. The first is an inlet port 48 arranged radially of the rotor for introducing hot contaminated gas from the associated appliance into exhaust gas chamber 28.

The second is an outlet port 50 arranged axially of the rotor for venting cooled exhaust gas from the exhaust gas chamber.

The third is a second inlet port 52 arranged axially of the rotor for introducing cool fresh air or other gas into supply gas chamber 30.

The fourth is a second outlet port 54 arranged radially of the supply gas chamber 30 for supplying heated fresh air to the associated appliance.

The fifth is a purge port 56 (FIG. 2) arranged radially of rotor 10 and disposed preferably substantially diametrically opposite first inlet port 48. It communicates with a duct 58 and purges from the exhaust gas chamber (boundary layer) a proportion of its content of exhaust gases with entrained particulates. If desired, a bag or filter (not shown) may be attached to the outlet of duct 58 to trap or filter out the entrained particulates.

A container (not shown) may be attached to the outlet of duct 58 to capture valuable condensed chemicals. In this case it is preferred to locate duct 56 at the bottom of the heat exchanger.

All of the radially disposed ports preferably are substantially coextensive in length with the chambers with which they communicate.

An airfoil 60 is mounted on the interior of case 10 in exhaust gas chamber 28. It extends substantially normal to the interior surface of the case, a substantial distance into annular space 46 containing the moving gaseous boundary layer. It is proportioned to intercept a substantial fraction of the circumferentially flowing boundary layer in annular space 46 for very heavily contaminated exhausts, and a lesser fraction for lightly contaminated exhausts.

The airfoil functions locally to impart turbulence in the gas comprising the boundary layer. It also functions to divert a predetermined proportion (sufficient to prevent accumulation of contaminants) of the gas content of the boundary layer, which content contains a preponderance of the solid or liquid particulates, into purge port 56 and thence into duct 58.

Operation

The operation of the self-cleaning, rotary heat exchanger of my invention is as follows:

Upon starting motor 20 and driving rotor 12 within case 10 in a counterclockwise direction as viewed in FIG. 2, centrifugal forces are developed within Perkins tubes 36, exhaust gas chamber 28, and supply air chamber 30. Also, a traveling circumferential boundary layer of moving air is established in annular space 46 of the exhaust gas chamber. The action of airfoil 60 causes the boundary layer to be turbulent in character in the region of airfoil 60.

If the rotative speed of driving rotor 12 is sufficiently high the boundary layer is everywhere turbulent; however, the turbulence at airfoil 60 is always greater.

Hot contaminated gas containing solid particulates and, perhaps, a content of gaseous solvents is introduced into exhaust gas chamber 28 via inlet port 48. Within the chamber, the gas follows in part the course of the arrows of FIG. 1. It passes through the revolving array of flanged Perkins tubes where heat transfer takes place, volatilizing the working fluid content of the tubes. The resultant hot vapors migrate to the condensation ends of the tubes in supply gas chamber 30 wherein they are condensed thereby liberating their heat of condensation. The cooled exhaust gas exits chamber 28 via outlet port 50.

A portion of the hot gas introduced into the chamber is contained in the traveling boundary layer present in annular space 46. This layer travels counterclockwise in the direction of the peripheral arrows of FIG. 2. It contains not only its original content of particulates, but also a major proportion of the total particulate content of the introduced gas, since particulates above a given size are thrown by centrifugal forces in the direction of the outer wall of the case, where they are entrained in and carried away by the boundary layer.

The boundary layer with its entrained content of particulates is intercepted by airfoil 60. A proportion of the boundary layer flow, determined in part by the radial length of the airfoil, is deflected out through purge port 56 into duct 58. It thereupon is vented to atmosphere, with or without filtering out the entrained particulates.

During this sequence, the inner wall of the case is scrubbed clean by the action of the traveling boundary layer. The spaces between the Perkins tubes and the flanged components thereof also are scrubbed clean by the turbulent flow of gas generated in the boundary layer by airfoil 60. The heat exchanger accordingly is self cleaning and self purging.

As noted above, the heat exchanger of the present invention also may be applied to the removal of processed solvents from hot exhaust gas streams. In such a case, it is preferred to avoid film type condensation on the heat exchange surfaces especially in cases where particulates also are present, or where polymerization of the condensed solvents may occur.

This result may be achieved by coating the heat exchange surfaces with a few-micron thickness of a water repellant material such as Teflon. The coating promotes dropwise condensation of many solvents including water. When dropwise condensation occurs, the areas not covered by drops are completely dry. The drops themselves are not strongly attached to the surface and accordingly are easily sheared-off by the gas flow within the heat exchanger, or thrown off by the action of the high force fields present therein. They accordingly are entrained on the traveling boundary layer and exhausted from the case.

On the other side of the heat exchanger, cool fresh air or other supply gas is introduced into supply gas chamber 30 via inlet port 52. It passes through the condensation ends of the Perkins tubes and out through outlet port 54 in the direction of the arrows of FIG. 1. While passing through the Perkins tube array, it cools the working fluid vapor within each tube, causing it to condense and liberate its heat of condensation. As shown in FIG. 3, the condensed liquid slightly raises the level of liquid within the Perkins tube which is opposite the lowering of the liquid level which occurs during evaporation at the other end of the tube.

Centrifugal force returns the condensed liquid to the hot evaporation end of the tube where the liquid is re-evaporated to complete the cycle. By this process the heat content of the working fluid vapor is transferred through the Perkins tube to the gas introduced into the supply gas chamber, from which it is vented through outlet port 54 to supply the associated appliance with fresh, hot air or other gas.

The major proportion of the supply exits through those finned Perkins tubes which, at a given time, are directly opposite outlet port 54. This increases the air velocity in the small gas flow channels and, in accordance with well-known observations, increases correspondingly airside heat transfer in the Perkins tubes.

The plurality of finned Perkins tubes rotate concentrically with the central shaft 14. This causes a centrifugal force to be exerted radially outward on supply gas in compartment 30 so that the static pressure of the heated supply gas is higher than the static pressure of the cool supply gas entering through inlet port 52. In other words, the supply side of the rotary heat exchanger behaves like a conventional blower driving the supply gas through the supply chamber and out through outlet portion 54. Its effect may be augmented by the inclusion of an appropriately sized fan in the assembly, if desired.

The essence of the invention, therefore, is the ability to recover thermal energy contained in a contaminated process effluent by employing a unitized self-contained apparatus. The apparatus accomplishes this by intercepting the incoming contaminated effluent with a circumferentially moving heat transfer surface whose center-of-rotation is downstream. The direction of the flowing effluent and the moving surface are approximately normal to each other. Accompanying the circumferentially moving surface are a radial centrifugal force directed upstream and a boundary layer flow moving concomitant with the surface and substantially normal to the effluent flow. Because the density of the contaminants is typically 1000 times the density of, for example, air, the radial centrifugal force is 1000 times more likely to let air pass radially inward through the finned surfaces than it is to let contaminants pass. If the process were to end here, the upstream contaminants would gradually accumulate in the incoming effluent and on the face of the finned surfaces until the effluent flow would stop.

The concept combines several features which prevent the aforementioned problems and, additionally, make the apparatus self-cleaning. The boundary layer flow traverses the incoming contaminated effluent in a substantially normal direction and continuously purges it to avoid accumulation of contaminants which have been rejected from the finned heat exchange surface by the radial centrifugal force. The boundary layer flow can be laminar, transitional, or turbulent depending upon the rotative speed and the rotor diameter.

When the finned heat exchanger surface is in the duct opening region, it is exposed directly to the dynamic pressure of the incoming effluent and particulates such as fibers may be held on the outer finned peripheral surface. When the finned surface passes by the duct opening into the region of the case, the dynamic pressure ceases to exist but the radial circumferential force continues, thereby, releasing the fibers to the boundary layer flow. The finned surface continues on its circumferential path accompanied by its boundary layer which now contains a much higher percentage of contaminants than are present in the incoming effluent.

At the airfoil, the boundary layer and its enhanced contaminants is purged out of the case through a purge port. The sudden interruption of the boundary layer flow at the airfoil causes a high degree of local turbulence irrespective of whether or not the boundary layer flow elsewhere is turbulent. This local turbulence effectively scrubs the adjacent finned heat exchange surfaces of any particles which may still be present thereon. The freed particles are thrown out of the finned surface by the radial centrifugal force and also are purged from the case through the purge port located just upstream of the airfoil. The finned heat exchange surface must be annular because the local turbulence created by the airfoil cannot penetrate very far into the inward radial direction.

Experimental Results

A self-cleaning rotary heat exchanger built substantially as described above and illustrated in the drawings was constructed and tested.

The cylindrical annular rotor consisted of two rows of finned Perkins tubes. The outer row and inner row each was comprised of 26 tubes which were arranged in the illustrated staggered or nested pattern. The diameter of the cylindrical annular roll when measured from one fin tip to the diametrically opposite fin tip was 22 inches. The inside dimension of the stationary case 10 was 24 inches. The annular space 46 was about 1 inch.

The finned Perkins tubes were made from Wolverine, Trufin Type h/a #61-0916058, a product of Calumet and Hecla, Inc. The inside diameters of the tubes were about 1 inch. Capillary circumferential grooves on the internal tube surfaces were not employed. There were 9 fins for each linear inch of tube length. The construction material was aluminum alloy.

The free space between the fins was 0.092 inch, i.e. the minimum dimension of the small airflow channels was 0.092 inch. The finned lengths in chambers 28 and 30 were each 19.25 inches and the dimensions of ports 48 and 54 were 18×18 inches square so that the counterflow incoming exhaust air and outgoing supply air both essentially traversed the entire finned length of the Perkins tubes in each chamber.

Each finned Perkins tube was charged with 262 grams of Freon-12 which, at room temperature, occupied a volume of 200 cubic centimeters, or 50% of the total internal volume. The internal volume of each tube was evacuated of all air so that the remaining 50% of the volume was only occupied by Freon-12 vapor which at 70° F. is at a pressure of 84.9 psia. The tubes were hermetically sealed to prevent the escape of Freon-12.

The ability of the self-cleaning rotary heat exchanger to transfer thermal energy from a heated exhaust airstream to a cool supply airstream was tested at various rotational speeds.

A propane heater, augmented by a fan, was employed to force heated exhaust air into port 48. A fan was also used to augment the supply air in inlet port 52 which was initially at a temperature of 76° F.

The efficiency or effectiveness of the unit increased from 44 percent at a rotational speed of 38 rpm to 70 percent at a rotational speed of 415 rpm.

At an inlet exhaust air temperature of about 200° F., the amount of heat transferred to the supply air was 7,526 BTU/hr at 38 rpm and 10,323 BTU/hr at 415 rpm. The increase in effectiveness at higher rotational speeds is predicated by the observed improvement in finned Perkins tube efficiencies in higher force fields. Higher effectiveness would have been realized if the internal tube surfaces employed circumferential grooves. The transition from laminar to turbulent boundary layer airflow in circumferential air space 46 was observed to occur at rotational speeds somewhat higher than 300 rpm.

The self-cleaning ability of the rotary heat exchanger was tested by a variety of methods. In the first, the propane heater used in the heat transfer test was eliminated but, otherwise, the test setup was the same.

To test self cleaning at low rotational speeds, a wheat dust aerosol was injected into the inlet exhaust air stream. The aerosol particles varied in size, with 87% by weight being less than 90 microns in size.

Testing at rotational speeds of 88 and 152 rpm indicated that 38% by weight of the particles passed through the finned Perkins tubes and out of the heat exchanger through port 50. 32% of the particles were deposited on the walls in the dead airspaces of the case, and 12% of the particles entered a filter attached to purge duct 58. No significant amount of aerosol accumulated on the fins, even at these low rotative speeds at which the boundary layer airflow was laminar. This proved conclusively that the local turbulence generated by airfoil 60 scrubbed the fins clean.

The apparatus also was tested at a transitional speed of 300 rpm.

Cornmeal flour was introduced into the exhaust chamber inlet 48. About 60% of the quantity introduced was recovered from the particulate/solvent filter bag attached to purge vent duct 58. When white all-purpose flour, instead of cornmeal flour, was introduced into the exhaust chamber, approximately 50% of the quantity introduced was captured in the filter bag. The particle size of white flour is smaller than the particle size of cornmeal flour. In both cases, no contamination was observed on the finned surfaces of the Perkins tubes.

Next, the hot, lint-contaminated air exhausted from a domestic 12-pound clothes dryer was directed into inlet port 48 of the heat exchanger exhaust chamber. The dryer was operated using a 60-minute drying cycle with the result that the exhaust air was at a high temperature and characterized by a high content of both moisture and lint particulates. The lint particulates were in the form of fibers too large to pass through the small airflow channels between the fins of the Perkins tubes. The speed of the rotor was set at 300 rpm. The lint fibers were captured in a filter bag attached to the outlet of purge duct 58.

At the conclusion of the operation, inspection of the heat exchanger fin surfaces revealed that they were completely free of lint. Also, the familiar matting of lint fibers observed in conventional fixed filters and fixed surface heat exchangers was completely absent.

Having thus described in detail preferred embodiments of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description. All changes which come within the meaning and range of equivalency of the claims are therefore to be embraced therein.

I claim:

1. A self-cleaning, rotary heat exchanger comprising:

(a) an outer case, (b) a rotor mounted for rotation within the case, longitudinally thereof, (c) means connected to the rotor for rotating it at a predetermined speed, (d) partition means mounted transversely on the rotor and dividing the case interior longitudinally into a hot exhaust gas chamber and a cool supply gas chamber, (e) an annular array of Perkins tubes mounted longitudinally on the rotor with their evaporation ends extending into the exhaust gas chamber and their condensation ends extending into the supply gas chamber, (f) first inlet port means in the case located for radially introducing into the exhaust gas chamber hot gas exhausted from an associated appliance and contaminated with entrained particu- lates, (g) first outlet port means in the case located axially for venting from the exhaust gas chamber a predetermined proportion of the exhaust gas in a cooled condition, (h) second inlet port means in the case located for introducing cool supply gas into the supply gas chamber, (i) second outlet port means in the case located for venting heated supply gas from the supply gas chamber to an associated appliance, (j) the rotor upon rotation creating a gas flow boundary layer, (k) longitudinally disposed airfoil means extending inwardly from the case into the hot exhaust gas chamber boundary layer a distance predetermined to create local turbulent gas flow therein, and (l) third outlet port means in the case located slightly upstream of the airfoil means for purging contaminated boundary layer airflow from the exhaust gas chamber.

2. The heat exchanger of claim 1 wherein the space between the rotor and the case is predetermined to locate the case within the gas flow boundary layer.

3. The heat exchanger of claim 1 including gas filter means positioned to filter the particulates from the vented exhaust gas.

4. The heat exchanger of claim 1 wherein the rotor comprises a longitudinally extending shaft mounting a central partition and a pair of end plates, one on each end of the shaft, the partition and end plates mounting the Perkins tubes.

5. The heat exchanger of claim 4 including on the interior surface of the case seal means for the partition and end plates, thereby sealing off from each other the exhaust gas chamber and the supply gas chamber.

6. The heat exchanger of claim 1 wherein the first inlet port means is disposed radially of the rotor and the first outlet port means is disposed axially thereof.

7. The heat exchanger of claim 1 wherein the second inlet port means is disposed axially of the rotor and the second outlet port means is disposed radially thereof.

8. The heat exchanger of claim 1 wherein the first inlet port is disposed radially of the rotor, the first outlet port means is disposed axially of the rotor, the second inlet port means is disposed axially of the rotor and the second outlet port means is disposed radially thereof.

9. The heat exchanger of claim 1 wherein the axial length of the first inlet port means extends substantially the entire length of the exhaust gas chamber.

10. The heat exchanger of claim 1 wherein the axial length of the second outlet port extends substantially the entire length of the supply gas chamber.

11. The heat exchanger of claim 1 wherein the first inlet port means extends substantially the entire axial length of the exhaust gas chamber and the second outlet port means extends substantially the entire axial length of the supply gas chamber.

12. The heat exchanger of claim 1 including a coating of water repellant material on the inside of the case.

13. The heat exchanger of claim 1 including a coating of water repellant material on the finned Perkins tubes.

14. The heat exchanger of claims 12 and 13 wherein the water repellant coating comprises "Teflon".

15. The heat exchanger of claim 1 wherein the Perkins tubes comprise externally finned Perkins tubes.

16. In a rotary, Perkins tube heat exchanger, a case located in the fluid flow boundary layer surrounding the rotor, purge port means in the case, and airfoil means extending inwardly from the case into the fluid flow boundary layer and operative to cause local turbulent fluid flow therein, as well as to divert a predetermined portion of the fluid flow out through the purge port means.

* * * * *